US009347360B2

(12) United States Patent
Kim

(10) Patent No.: US 9,347,360 B2
(45) Date of Patent: May 24, 2016

(54) STRUCTURE FOR PREVENTING HEAT OF MUFFLER FOR CONSTRUCTION MACHINE FROM BEING DIFFUSED

(75) Inventor: Sang-Deuk Kim, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 0 days.

(21) Appl. No.: 14/414,724

(22) PCT Filed: Jul. 25, 2012

(86) PCT No.: PCT/KR2012/005928

§ 371 (c)(1),
(2), (4) Date: Jan. 14, 2015

(87) PCT Pub. No.: WO2014/017676

PCT Pub. Date: Jan. 30, 2014

(65) Prior Publication Data

US 2015/0204229 A1 Jul. 23, 2015

(51) Int. Cl.

| | |
|---|---|
| ***F01N 13/14*** | (2010.01) |
| ***F01N 1/00*** | (2006.01) |
| ***E02F 9/08*** | (2006.01) |

(52) U.S. Cl.

CPC ..... *F01N 13/14* (2013.01); *E02F 9/0866* (2013.01); *F01N 1/00* (2013.01); *F01N 13/148* (2013.01); *F01N 2590/08* (2013.01)

(58) Field of Classification Search

CPC ... F01N 13/14; F01N 13/148; F01N 2590/08; B60K 13/04; F02B 77/11; E02F 9/0866

USPC ..... 180/89.2, 68.1

See application file for complete search history.

(56) References Cited

U.S. PATENT DOCUMENTS

| | | | | | |
|---|---|---|---|---|---|
| 4,265,332 | A * | 5/1981 | Presnall | F01N 3/05 | 165/52 |
| 4,442,585 | A * | 4/1984 | McGehee, Sr. | F16L 59/026 | 138/149 |
| 5,029,668 | A * | 7/1991 | Murakawa | F01N 3/05 | 181/240 |
| 5,844,177 | A * | 12/1998 | Pirchl | B60R 13/08 | 180/89.2 |
| 6,026,768 | A * | 2/2000 | Spitler | B60K 11/08 | 123/41.58 |

(Continued)

FOREIGN PATENT DOCUMENTS

| | | |
|---|---|---|
| JP | 2001-303614 A | 10/2001 |
| JP | 2002-070075 A | 3/2002 |

(Continued)

OTHER PUBLICATIONS

International Search Report (in Korean and English) and Written Opinion (in Korean) for PCT/KR2012/005928, mailed Mar. 15, 2013; ISA/KR.

*Primary Examiner* — Keith Frisby
(74) *Attorney, Agent, or Firm* — Harness, Dickey & Pierce, P.L.C.

(57) ABSTRACT

Disclosed is a structure for preventing the heat of a muffler from being diffused, which prevents the heat generated by the muffler from being diffused into the peripheral components in the engine room and discharges the heat through the engine hood to the outside. The structure for preventing the heat of the muffler for a construction machine includes a plurality of frames mounted on the bottom of the engine room outside the muffler, a shield supported by the frames so as to surround the outside of the muffler to form a shielding area, and a detachment means formed on one side of the shield.

8 Claims, 3 Drawing Sheets

(56) References Cited

U.S. PATENT DOCUMENTS

| | | | | |
|---|---|---|---|---|
| 6,090,495 | A * | 7/2000 | Pirchl | F16L 59/08 428/593 |
| 6,302,066 | B1 * | 10/2001 | Steinmann | B60K 11/02 123/41.49 |
| 7,481,248 | B2 * | 1/2009 | Prociw | F16L 59/026 138/110 |
| 2010/0132347 | A1 * | 6/2010 | Ikeda | E02F 9/00 60/320 |
| 2012/0012733 | A1 * | 1/2012 | Fowler | B60K 13/04 248/674 |
| 2014/0165968 | A1 | 6/2014 | Kim | |

FOREIGN PATENT DOCUMENTS

| | | | |
|---|---|---|---|
| JP | 2005-068810 | A | 3/2005 |
| JP | 2009-144511 | A | 7/2009 |
| JP | 2010-007525 | A | 1/2010 |
| KR | 10-2001-0049774 | A | 6/2001 |

* cited by examiner

STRUCTURE FOR PREVENTING HEAT OF MUFFLER FOR CONSTRUCTION MACHINE FROM BEING DIFFUSED

TECHNICAL FIELD

The present invention relates to a structure for preventing thermal diffusion from a muffler for a construction machine. More particularly, the present invention relates to a structure for preventing thermal diffusion from a muffler for a construction machine, which is configured to prevent heat (e.g., heat with a temperature of 400-500° C. generated from a muffler from being diffused to peripheral components in an engine room and discharge the heat to the outside through an engine hood.

BACKGROUND ART

Recently, a muffler (particularly, called "combine muffler") installed in an excavator to comply with T4F engine regulations is provided with an after-treatment device for reducing an exhaust gas. In other words, an after-treatment device technology such as diesel oxidation catalyst (DOC) or selective catalytic reduction (SCR) is applied to the muffler.

The after-treatment device can reduce noxious substances such as nitrogen oxides and the like discharged from the engine, but involves high temperature heat which is transferred to the periphery of the inside of the engine to cause peripheral components (e.g., engine hood, engine valve cover, electrical and electronic components, etc) to be deformed (for example, if the internal temperature of the engine room rises to 120° C., the engine hood made of a plastic material can be deformed or melted due to the heat), or cause electric circuit components to be operated erroneously (for example, if the internal temperature of the engine room rises to 130° C., the electrical and electronic components and the like can be operated erroneously).

In addition, there may occur a problem in that when an operator or the like performs a work around the muffler that generates the high temperature heat or opens/closes the engine hood, he or she suffers a burn due to hot air and heat.

Therefore, there is a need for a device for preventing the high temperature heat generated from the muffler from being diffused to the periphery of the engine room.

Korean Patent Laid-Open Publication No. 2001-0049774 discloses a construction machine. The above 49774' document teaches that a compartment 14 for accommodating a muffler 9 is installed inside an engine room 12, and a ventilation unit 15*a* is provided on a bottom of the compartment 14 to allow an external air and the inside of the compartment 14 to communicate with each other through the ventilation unit By virtue of this configuration, heat generated from the muffler is blocked in the compartment to prevent the heat from being transferred to the inside of the engine room, and the ventilation unit prevents the external air from being introduced into the compartment to suppress a rise of the temperature of the compartment.

In this case, the ventilation unit is provided to allow the external air to be introduced into the compartment, but still entails a problem in that the internal temperature of the compartment rises due to a small opened area of the ventilation unit.

Further, Japanese Patent Laid-Open Publication No. 2010-007525 discloses a construction machine. The above 7525' document teaches that a building member 16 is provided to surround a hydraulic pump 11, and a shielding cover 17 is installed in the building member 16 to block between an engine 9 and the hydraulic pump 11. A treatment device installation part 17A is provided on the shielding cover 17 to install an exhaust gas treatment device 18, and a subassembly 15 is installed at a swing frame 5. The invention of the above 7525' document is intended to protect other hydraulic components besides the engine 9 from the heat generated from the muffler and the exhaust gas treatment device 18.

DISCLOSURE

Technical Problem

Accordingly, the present invention has been made to solve the aforementioned problems occurring in the prior art, and it is an object of the present invention to provide a structure for preventing thermal diffusion from a muffler for a construction machine, which can prevent the deformation of peripheral components (e.g., engine hood made of a plastic material, etc.) in an engine room, or the erroneous operation of electric circuit components due to high temperature heat generated from the muffler.

Another object of the present invention is to provide a structure for preventing thermal diffusion from a muffler for a construction machine, which can protect an operator from a burn caused by high temperature heat of the periphery of the muffler.

Technical Solution

To achieve the above objects, in accordance with an embodiment of the present invention, there is provided a structure for preventing the diffusion of heat generated from a muffler mounted inside an engine room of a construction machine in accordance with an embodiment of the present invention, the structure including:

a plurality of frames mounted on a bottom of the engine room at an outside of the muffler;

a shielding film supported by the frames to surround an outer wall of the muffler to define a shielding area in the engine room; and a detachable means formed at one side of the shielding film.

In accordance with a preferred embodiment, an upper portion of the shielding area that is defined by the shielding film 20 may be configured to be opened so that heat generated from the muffler 21 and gathered in the shielding area can be discharged toward an engine hood.

The shielding film may be formed as a mesh structure.

The shielding film may be formed of a glass fiber material, a textile fabric material, or a silicon material.

The shielding film may be formed as a double-layered structure.

The shielding film may have a through-hole formed on one side thereof to allow an exhaust pipe to pass therethrough.

The detachable means may be formed as a snap fastener 25.

Advantageous Effect

The structure for preventing thermal diffusion from a muffler for a construction machine in accordance with the present invention as constructed above has the following advantages.

The high temperature heat generated from the muffler is blocked from being diffused to the periphery of the inside of the engine room so that the deformation of the peripheral components in the engine room or the erroneous operation of the electric circuit components can be prevented. In addition, an operator can be protected from a burn caused by high temperature heat of the periphery of the muffler.

BRIEF DESCRIPTION OF THE DRAWINGS

The above objects, other features and advantages of the present invention will become more apparent by describing the preferred embodiments thereof with reference to the accompanying drawings, in which.

EXPLANATION ON REFERENCE NUMERALS OF MAIN ELEMENTS IN THE DRAWINGS

Figure 1:
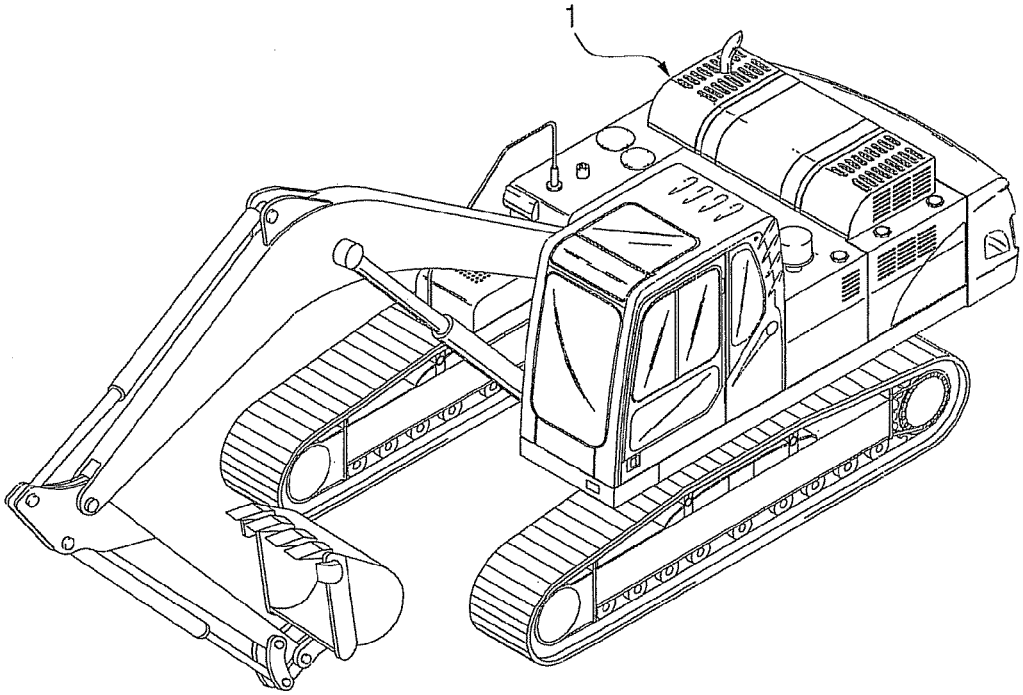
FIG. 1 is a perspective view showing an excavator to which the present invention is applied.

10: frames
11: support plate
12: fastening member
13: angle member
14: elongated hole
20: shielding film
21: muffler
23: through-hole
25: snap fastener

PREFERRED EMBODIMENTS OF THE INVENTION

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

FIG. 1 is a perspective view showing an excavator to which the present invention is applied. An engine room where a muffler is installed is denoted by a reference numeral 1.

Figure 2:
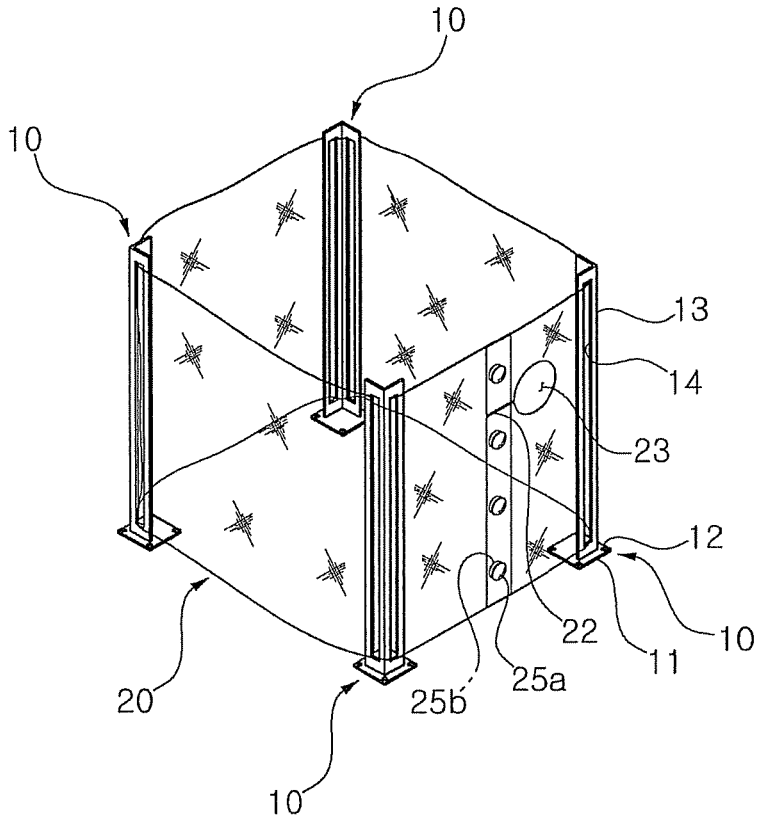
FIG. 2 is a perspective view showing a structure for preventing thermal diffusion from a muffler for a construction machine in accordance with an embodiment of the present invention.
Figure 3:
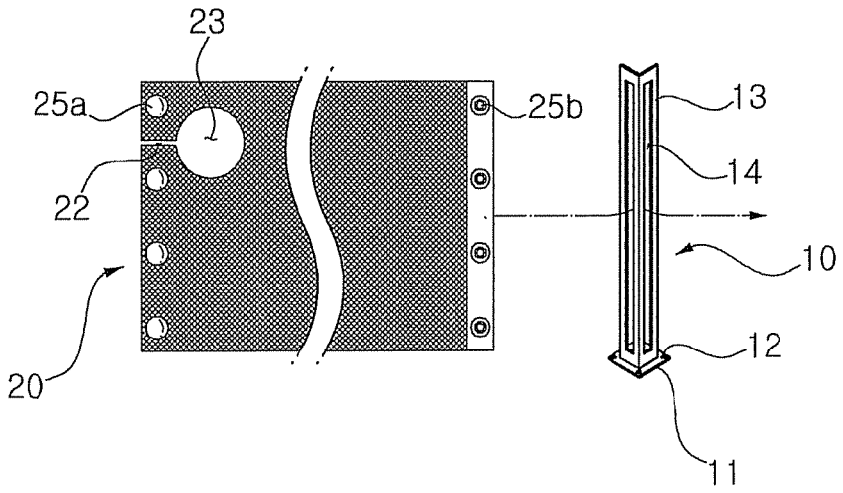
FIG. 3 is a view showing a detachable means for fixing a shielding film in a structure for preventing thermal diffusion from a muffler for a construction machine in accordance with an embodiment of the present invention.
Figure 4:
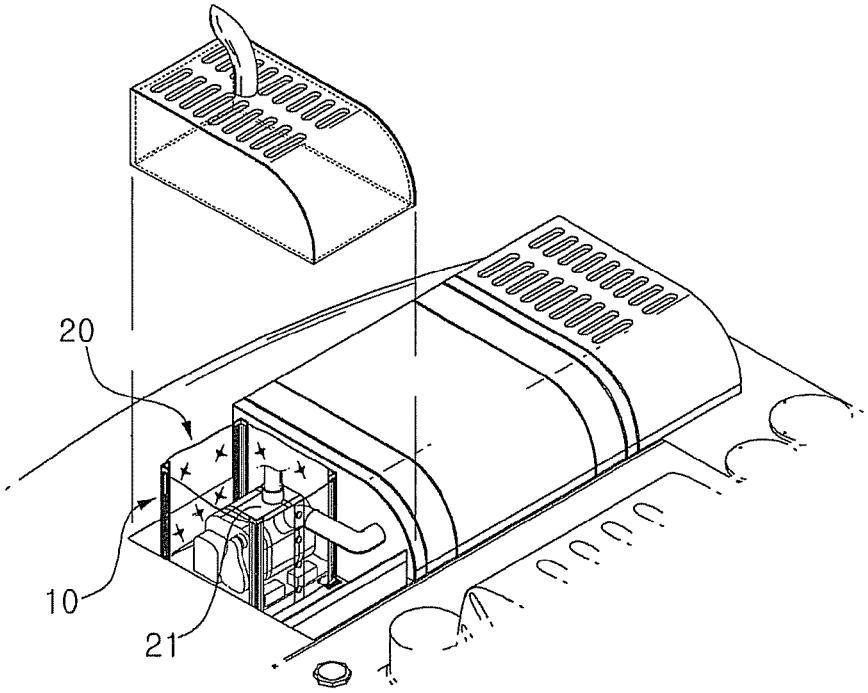
FIG. 4 is a view showing a use state of a structure for preventing thermal diffusion from a muffler for a construction machine in accordance with an embodiment of the present invention.

FIG. 2 is a perspective view showing a structure for preventing thermal diffusion from a muffler for a construction machine in accordance with an embodiment of the present invention, FIG. 3 is a view showing a detachable means for fixing a shielding film in a structure for preventing thermal diffusion from a muffler for a construction machine in accordance with an embodiment of the present invention, and FIG. 4 is a view showing a use state of a structure for preventing thermal diffusion from a muffler for a construction machine in accordance with an embodiment of the present invention.

A structure for preventing the diffusion of heat generated from a muffler mounted inside an engine room of a construction machine, includes:

a plurality of frames 10 mounted on a bottom of the engine room at an outside of the muffler 21;

a shielding film 20 supported by the frames 10 to surround an outer wall of the muffler 21 (e.g., a combine muffler including an after-treatment device) to define a shielding area in the engine room so that high temperature heat generated from the muffler 21 can be prevented from being diffused to the inside of the engine room; and a detachable means formed at one side of the shielding film 20.

An upper portion of the shielding area that is defined by the shielding film 20 can be configured to be opened so that heat generated from the muffler 21 and gathered in the shielding area can be discharged toward an engine hood.

The structure for preventing thermal diffusion from a muffler for a construction machine in accordance with an embodiment of the present invention includes the plurality of frames 10 and the shielding film 20. Each of the frames 10 is installed in an area that can surround the periphery of the muffler 21 installed in the engine room. As an example of the frames 10, four frames 10 are shown in FIGS. 2 to 4. An area defined by the frames 10 is divided from the periphery of the inside of the engine room, and thus is an area that encircles the muffler 21. This area is referred to as a 'shielding area'. Each of the frames 10 is a post that forms the boundary of the shielding area.

The shielding area is preferably set in consideration of the relationship between the muffler 21 and the peripheral components in the engine room. Since the present invention is mainly aimed at blocking the heat generated from the muffler 21 from being transferred to the peripheral components in the engine room, it must be taken into consideration in terms of the heat transfer. This does not mean that the smaller the shielding area is, the better it is, or the larger the shielding area is, the better it is. In other words, the most optimum layout of the shielding area can be determined in consideration of the shielding of the heat generated from the muffler 21 and the interference of the electrical and electronic components, etc., mounted inside the engine room.

Each of the frames 10 can be securely fixed to the bottom of the engine room through a support plate 11 formed at a lower portion thereof by means of a fastening member 12.

An angle member 13 is vertically mounted to the support plate 11. In the case where the shielding area is formed in a quadrangular shape, the angle member 13 having a right angled surface is preferably formed. The length of the angle member 13 can be set to a length corresponding to the height of the shielding area. In this case, the length of the angle member 13 must be determined in consideration of a possibility of heat transfer or interference between the muffler 21 and the peripheral components in the engine room, and the like.

The angle member 13 has a pair of elongated holes 14 formed on an angle surface thereof, which is formed in a right-angled shape. The shielding film 20 is easily mounted on the frames 10 by virtue of the elongated holes 14, and a tension of the shielding film 20 is increased so that the shielding film 20 can be prevented from being displaced due to vibration. That is, since the shielding film 20 is supported by the angle members 13 while passing through the elongated holes 14 formed on the angle surface of each of the angle members 13, it can be maintained in a tightly pulled state.

The shielding film 20 is inserted through the elongated holes 14 formed on the angle members 13.

The width of the shielding film 20 can be set to be equal to the length of the elongated hole 14, and the length of the shielding film 20 can be set to be equal to the circumference of the four frames 10 that defines a rectangular parallelepiped shape.

The shielding film 20 is inserted through the elongated holes 14 of the installed angle members 13, and is supportedly installed on each of the frames 10. As shown in FIGS. 2 and 3, the shielding film 20 is formed in a roll shape such that it is inwardly inserted through one elongated hole 14 of the angle surface of each of the angle members 13 and then outwardly passes through the other elongated hole 14 of the angle surface.

A detachable means is formed at both transverse ends of the shielding film 20. As shown in FIGS. 2 and 3, the detachable means may be formed as a snap fastener 25 consisting of female and male engagement elements 25*a* and 25*b*. The snap fastener 25 facilitates the assembly of the shielding film 20 and the release from the assembly upon the replacement of the shielding film 20. The detachable means may be modified into a Velcro tape or the like.

The shielding film 20 may be formed of a glass fiber material, a textile fabric material, or a silicon material.

The shielding film 20 may be formed as a mesh structure. The shielding area is in a high temperature state, and the periphery of the shielding area is in a relatively low temperature state. For this reason, when the heat inside the shielding area is discharged to the outside through an opened portion of the upper end of the shielding area, ambient air flows into the shielding area so that the flow of air can be promoted.

The shielding film 20 may be formed as a double- or triple-layered structure. If the shielding film 20 is formed as a multi-layered structure, a shielding property can be enhanced, and if the shielding film 20 is formed as a mesh structure, a shielding effect can be further increased.

In a modified embodiment of the shielding film 20 formed as the double-layered structure, a plurality of shielding films may be separately formed in such a manner as to form sidewall faces thereof, each of which is defined by two adjacent frames 10. In other words, a separate shielding film can be fixed to two adjacent frames 10. As such, when the plurality of shielding films may be separately provided, a separate detachable means may be formed on each of the shielding films. The shielding film 20 may have a through-hole 23 formed on one side thereof to allow an exhaust pipe to pass therethrough.

INDUSTRIAL APPLICABILITY

In accordance with the present invention as constructed above, heat generated from a combine muffler mounted in an excavator is blocked from being diffused to the periphery of the inside of the engine room so that the deformation of the peripheral components in the engine room or the erroneous operation of the electric circuit components due to the heat can be prevented.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

What is claimed is:

1. A structure for preventing the diffusion of heat generated from a muffler mounted inside an engine room of a construction machine, comprising:

a plurality of frames mounted on a bottom of the engine room at an outside of the muffler;

a shielding film supported by the frames to surround an outer wall of the muffler to define a shielding area in the engine room; and a detachable means formed at one side of the shielding film.

2. The structure according to claim 1, wherein an upper portion of the shielding area that is defined by the shielding film is configured to be opened so that heat generated from the muffler and gathered in the shielding area can be discharged toward an engine hood.

3. The structure according to claim 1, wherein each of the frames is formed as an angle member mounted on the bottom of the engine room, the angle member having a pair of elongated holes formed on an angle surface thereof so as to increase a tension of the shielding film that is supported by the frame.

4. The structure for preventing thermal diffusion according to claim 1, wherein the shielding film is formed as a mesh structure.

5. The structure for preventing thermal diffusion according to claim 4, wherein the shielding film is formed of a glass fiber material, a textile fabric material, or a silicon material.

6. The structure for preventing thermal diffusion according to claim 1, wherein the shielding film is formed as a double-layered structure.

7. The structure for preventing thermal diffusion according to claim 1, wherein the shielding film has a through-hole formed on one side thereof to allow an exhaust pipe to pass therethrough.

8. The structure for preventing thermal diffusion according to claim 1, wherein the detachable means is formed as a snap fastener.

* * * * *